US005930285A

United States Patent [19]

Moller

[11] Patent Number: 5,930,285

[45] Date of Patent: Jul. 27, 1999

[54] HEATING ELEMENT SUPPORT FOR AN ELECTRIC HEAT TREATING FURNACE

[75] Inventor: Craig A. Moller, Roscoe, Ill.

[73] Assignee: Ipsen International, Inc., Cherry Valley, Ill.

[21] Appl. No.: 08/858,496

[22] Filed: May 19, 1997

[51] Int. Cl.[6] ..... H05B 3/66

[52] U.S. Cl. ..... 373/128; 373/130

[58] Field of Search ..... 373/128, 129, 373/130, 131, 137

[56] References Cited

U.S. PATENT DOCUMENTS

| | | |
|---|---|---|
| 3,456,935 | 7/1969 | Bornor . |
| 3,737,553 | 6/1973 | Kreider et al. . |
| 3,812,276 | 5/1974 | Cyrway, Jr. et al. . |
| 4,056,678 | 11/1977 | Beall, III et al. . |
| 4,156,792 | 5/1979 | McFadden et al. . |
| 4,259,538 | 3/1981 | Jones . |
| 4,559,631 | 12/1985 | Moller . |
| 4,612,651 | 9/1986 | Moller et al. . |
| 4,860,306 | 8/1989 | Gibb . |
| 5,502,742 | 3/1996 | Kellogg et al. . |

FOREIGN PATENT DOCUMENTS

| | | |
|---|---|---|
| 2933903 | 3/1980 | Germany . |
| WO9416278 | 7/1994 | WIPO . |

OTHER PUBLICATIONS

"Detail–1" from Abar Ipsen production drawing (Date Unknown).

Drawing No. B–178923, Abar Ipsen Industries, Inc., (Jun. 30, 1995).

Drawing No. D–161340, Ipsen Industries, Inc. (Jun. 11, 1987).

*Primary Examiner*—Teresa Walberg
*Assistant Examiner*—Quang Van
*Attorney, Agent, or Firm*—Dann, Dorfman, Herrell and Skillman, P.C.

[57] ABSTRACT

A support or hanger for an electric heating element in a heat treating furnace is disclosed. The heating element support includes a support arm having first and second end portions. First and second ceramic sleeves extend transversely through the support arm and a bracket surrounds at least three sides of the support arm. The bracket is dimensioned and positioned to engage with, and thereby support, the electric heating element. First and second pairs of ceramic spacers are disposed annularly on said first and second ceramic sleeves, respectively. The ceramic spacers are positioned between the bracket and the support arm to prevent contact between the support arm and the bracket. A pin is disposed within each of the first and second ceramic sleeves and extends through the bracket to support and retain the ceramic sleeves, the ceramic spacers, and the bracket on the support arm. In this arrangement, the heating element bears on the metallic bracket and does not cause wear or damage to the ceramic elements. The bracket also provides a shield against contamination and metallization of the ceramic components. A cap is disposed over the first end portion of the support arm and a portion of the bracket adjacent thereto and is supported and retained on the bracket by the inboard retaining pin. The cap provides a shield for the ceramic components, particularly those that are disposed along the floor or bottom of the furnace hot zone.

27 Claims, 3 Drawing Sheets

HEATING ELEMENT SUPPORT FOR AN ELECTRIC HEAT TREATING FURNACE

FIELD OF THE INVENTION

This invention relates to electric furnaces for the heat treating of metals, and in particular, to a support or hanger for the electric heating elements used in such furnaces.

BACKGROUND OF THE INVENTION

Electric heat treating furnaces utilize electric heating elements formed of molybdenum or graphite as radiant heat sources. The electric heating elements are usually arrayed circumferentially around the hot zone of the furnace. U.S. Pat. Nos. 5,502,742; 4,612,651; 4,559,631; and 3,812,276, the disclosures of which are incorporated herein by reference, show and describe typical arrangements of heat treating furnaces having electric heating elements .

In the known furnaces, the electric heating elements are supported from the furnace wall by hangers or support members which are attached to the furnace wall at one end and which include hardware for attaching the heating element thereto at their other end. Typically, the heating element support includes electrical insulating components so that the heating element is electrically isolated from the portion of the element support that is attached to the furnace wall. The electrical insulating components are usually formed of a ceramic material. Over time, during repeated operation of the furnace, the surface of the ceramic components becomes contaminated from materials that are dropped on them or by progressive metallization. Such contamination leads to electrical short circuits that interrupt furnace operation and can cause damage.

In electric heat treating furnaces that include forced gas cooling systems, the ceramic insulating components are subject to high stress from thermal shock which can cause cracking and failure of the component. In the furnaces, the ceramic insulating components are in direct contact with the heating element and are subject to stresses when the heating element expands or contracts during heating and cooling cycles. Furthermore, during furnace operation or maintenance, heating element supports on the bottom or hot zone floor of a furnace can be struck by falling parts or tools, which cause the ceramic components to crack or break.

Many of the known heating element supports include a support shaft that threads into the wall of the hot zone or furnace. Such a heating element support is subject to distortion and galling from thermal cycling in the furnace. That distortion and galling causes the threaded portion of the stand-off to seize, which makes the heating element support very difficult to remove when it must be repaired or replaced.

Another drawback to the known heating element supports is that they must be specifically designed for either graphite or metal heating elements because a graphite heating element is significantly thicker than a metal heating element.

In view of the foregoing, it would be highly desirable to have a support for an electric heating element in an electric heat treating furnace which overcomes the disadvantages of the known heating element supports.

SUMMARY OF THE INVENTION

The disadvantages associated with the known furnace heating element supports are resolved to a large degree by a heating element support in accordance with the present invention. A support for an electric heating element according to this invention includes a support arm having first and second end portions. First and second ceramic sleeves extend transversely through the support arm and a bracket surrounds at least three sides of the support arm. The bracket is dimensioned and positioned to engage with, and thereby support, the electric heating element. The bracket has a transverse interior dimension that is greater than the lengths of the first and second ceramic sleeves, respectively. A pair of first ceramic spacers are disposed annularly on said first ceramic sleeve and a pair of second ceramic spacers are disposed annularly on said second ceramic sleeve. The ceramic spacers are positioned between the bracket and the support arm to prevent contact between the support arm and the bracket. A pin is disposed within each of the first and second ceramic sleeves. The pins extend through the bracket to support and retain the ceramic sleeves, the ceramic spacers, and the bracket on the support arm. Clips are provided for retaining the pins within the ceramic sleeves and the bracket. In this arrangement, the heating element bears on the metallic bracket and does not cause wear or damage to the ceramic elements. The bracket also provides a shield against contamination and metallization of the ceramic components.

In accordance with another aspect of the present invention, the heating element support includes a cap disposed over the first end portion of the support arm and a portion of the bracket adjacent thereto. The inboard retaining pin also extends through the cap for to support and retain the cap on the bracket and support arm. The cap provides a shield for the ceramic components, particularly those that are disposed along the floor or bottom of the furnace hot zone.

In accordance with a further aspect of this invention the heating element support includes a socket adapted to be affixed to a wall of the heat treating furnace. The socket is formed for receiving and engaging with the second end portion of the support arm so that the heating element support can be mounted in the electric heat treating furnace. In this arrangement, the support arm has a notch formed transversely in the second end portion and the socket includes a pin or other means for engaging with the notch to retain the support arm in the socket. Engagement is accomplished by inserting and twisting the support arm in the socket.

BRIEF DESCRIPTION OF THE DRAWINGS

The foregoing summary as well as the following detailed description of a preferred embodiment of the present invention will be better understood when read in conjunction with the appended drawings, wherein.

DETAILED DESCRIPTION OF THE INVENTION

Figure 1:
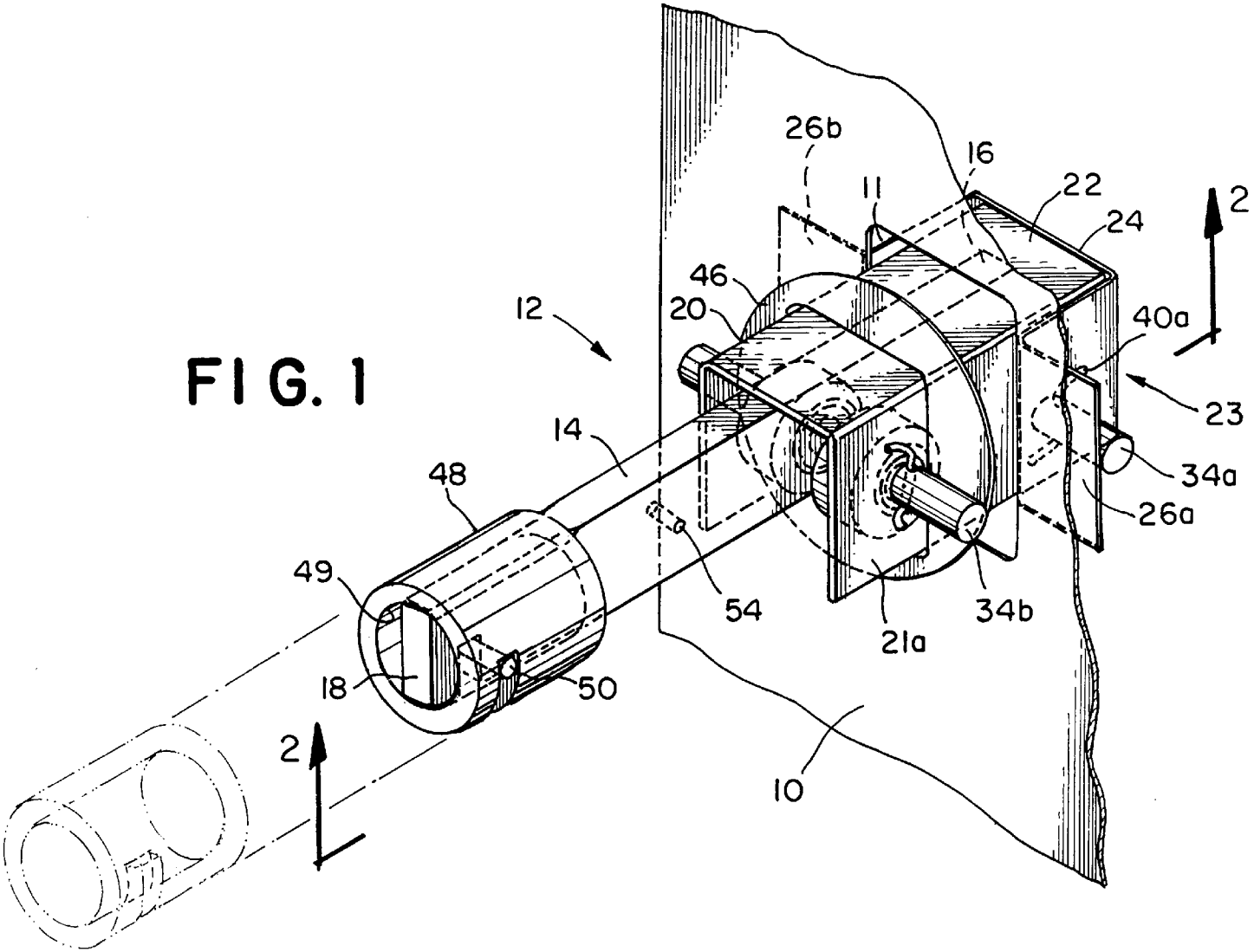
FIG. 1 is a perspective view of an electric heating element and a support therefor in accordance with the present invention.
Figure 2:
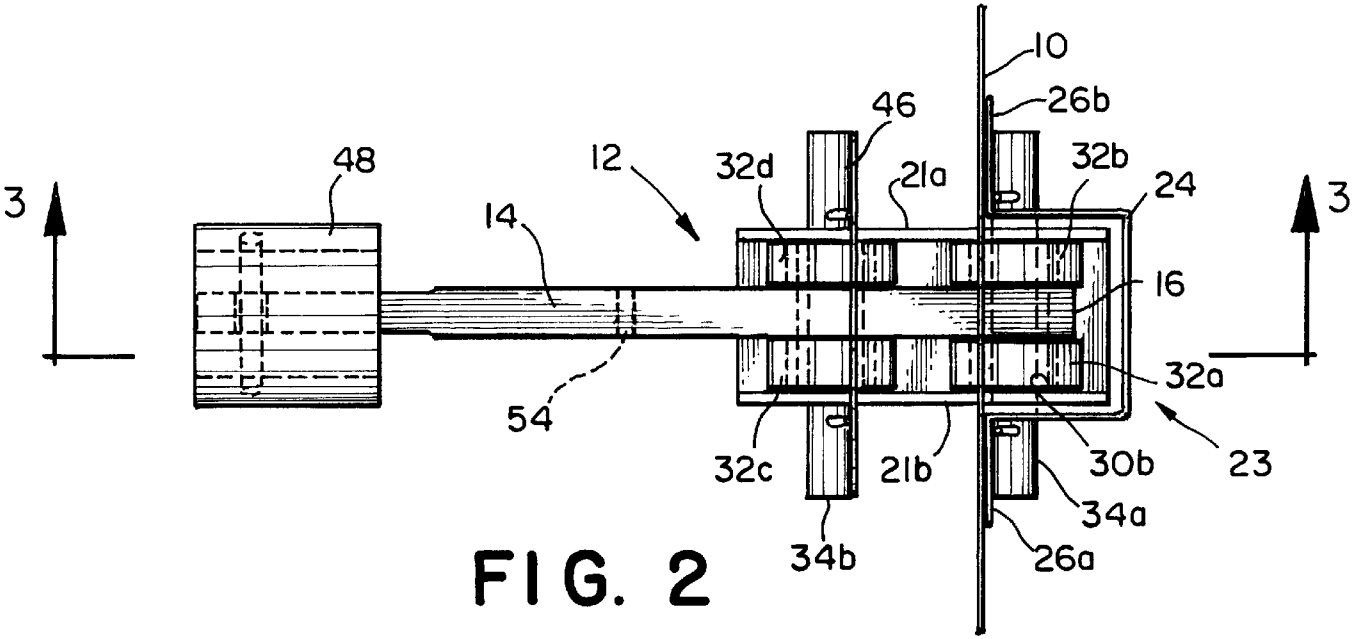
FIG. 2 is a bottom plan view of the heating element support shown in FIG. 1, as viewed along line 2—2 therein.
Figure 3:
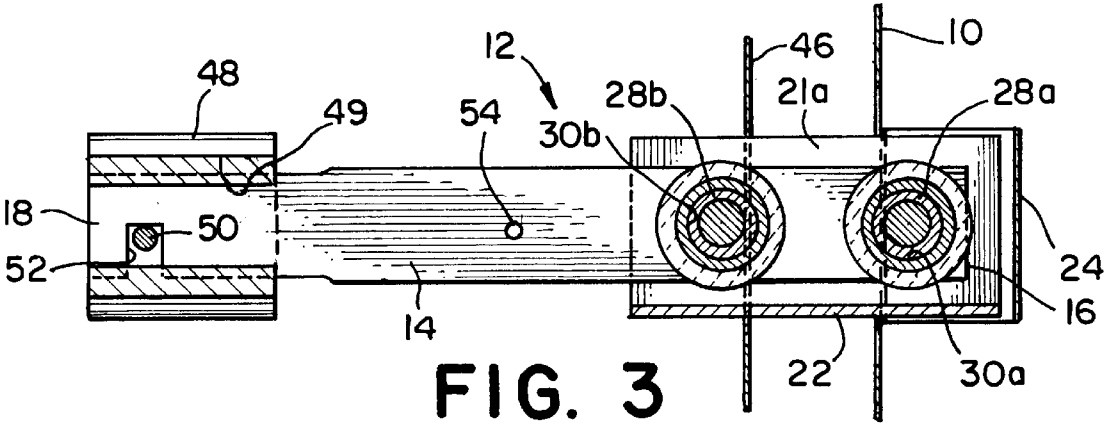
FIG. 3 is a side elevation view in partial section of the heating element support shown in FIG. 2, as viewed along line 3—3 therein.
Figure 4:
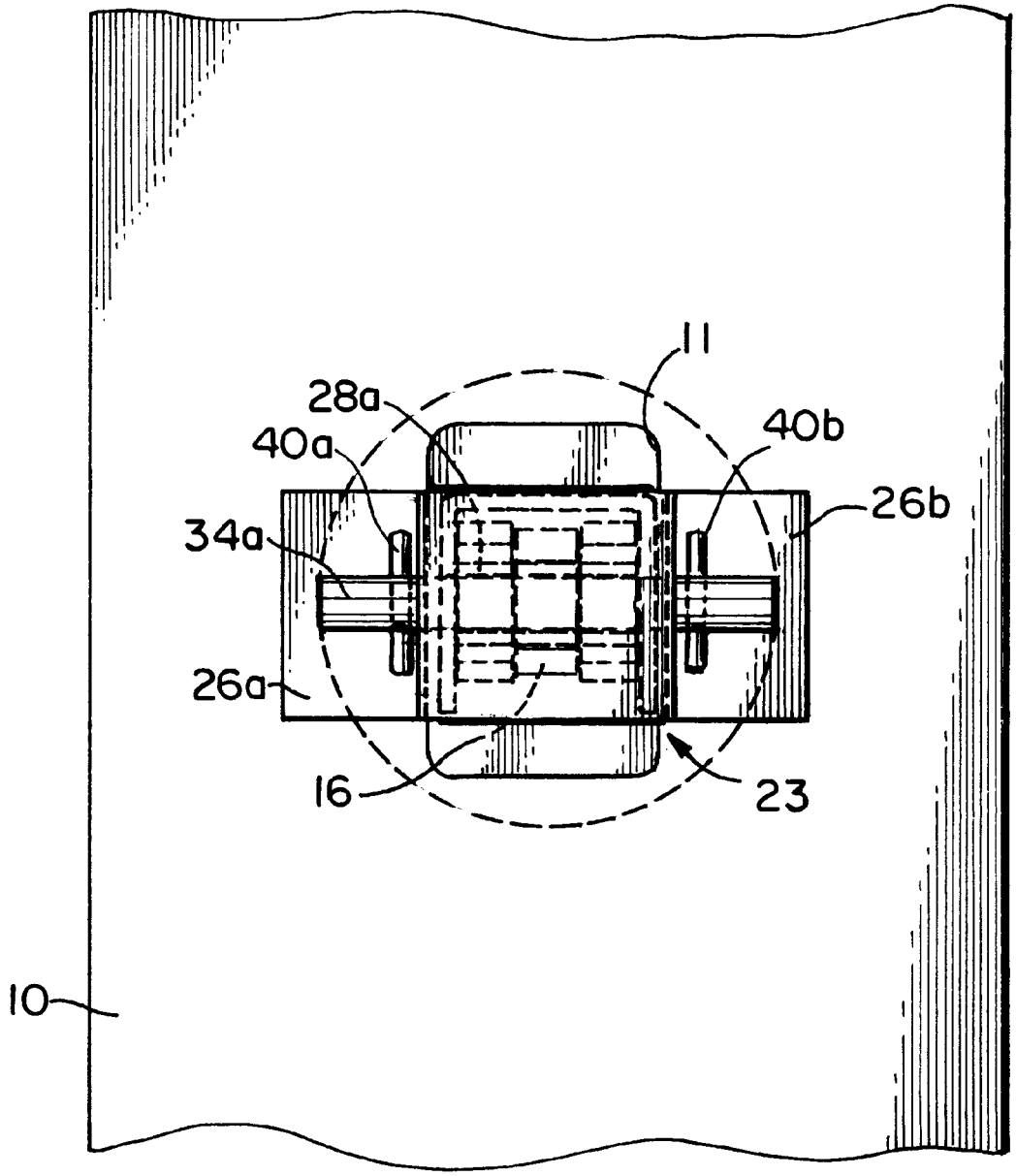
FIG. 4 is a front elevation view of the heating element support shown in FIG. 1.

Referring now to the drawings wherein like reference numerals refer to the same components across the several views, there is shown a portion of an electric heating element 10 of the type used in an electric heat treating furnace. The heating element 10 has an opening 11 formed therein for receiving a heater element support 12. The heater element support 12 includes an elongated bar member 14 which has an inboard end portion 16 and an outboard end portion 18. In the embodiment shown in the drawing figures, bar member 14 has a generally rectangular cross section. A U-shaped bracket 20 surrounds the inboard end portion of bar member 14 on at least three sides thereof. The U-shaped bracket 20 includes a pair of opposing sidewalls 21*a* and 21*b*, and a top portion 22 extending between the sidewalls. The opening 11 is oversized relative to the cross-sectional area of the bracket 20 to permit easy fit up when the heating element 10 is assembled to the support 12. The oversized nature of the opening 11 also allows for some expansion of bracket 20 during operation of the heat treating furnace at elevated temperature.

A cap 23 having a U-shaped portion 24 and flange portions 26*a* and 26*b* is mounted on the inboard end of bar member 14. The U-shaped portion 24 overlaps a portion of bracket 20 adjacent the inboard end portion 16 of bar member 14 to close off the open end of bracket 20. The flange portions 26*a* and 26*b* of cap 23 are positioned and oriented to abut the electric heating element 10 on the inboard surface thereof.

Ceramic sleeves 28*a* and 28*b* extend through holes formed in bar member 14. The length of the ceramic sleeves 28*a*, 28*b* is slightly less than the transverse internal dimension of bracket 20 so that they do not interfere with the assembly of the bracket 20 onto bar member 14. A pair of ceramic spacers 32*a*, 32*b* are disposed annularly on ceramic sleeve 28*a* on opposite sides of bar member 14. In like manner, ceramic spacers 32*c* and 32*d* are disposed annularly on ceramic sleeve 28*b* on opposite sides of bar member 14. The ceramic spacers 32*a*, 32*b*, 32*c*, and 32*d* are thus situated between bar member 14 and the sidewalls 21*a* and 21*b* of bracket 20 to prevent contact therebetween.

A metallic pin 34*a* is disposed in ceramic sleeve 28*a* and extends outwardly through holes in the sidewalls of bracket 20 and in the U-shaped portion 24 of cap 23. In like manner, a second metallic pin 34*b* is disposed in ceramic sleeve 28*b* and extends through holes in the sidewalls of bracket 20. The ends of metallic pins 34*a* and 34*b* extend a distance beyond the sidewalls of bracket 20. In the case of pin 34*a*, the extra length ensures that cap 23 is secured to the bracket 20 thereby preventing the heating element 10 from slipping off of bracket 20. Retaining clips 40*a*, 40*b*, and 40*c*, 40*d* are inserted through holes formed in the metallic pins 34*a*, 34*b*, respectively, outboard of the sidewalls 21*a*, 21*b* of bracket 20 to prevent the metallic pins 34*a*, 34*b* from sliding out of the ceramic sleeves 28*a*, 28*b* and bracket 20. The flanges 26*a* and 26*b* of cap 23 are positioned between metallic pin 34*a* and the heating element 10 to help retain the heating element 10 on the support 12 and to prevent galling or abrasion of the heating element by pin 34*a*.

A washer 46 is slidably disposed around the U-shaped bracket 20 outboard of heating element 10. In the embodiment shown in the drawings, the electric heating element is realized by a metallic strip or band. However, as noted above, some electric heat treating furnaces utilize graphite bars for the heating elements. The metallic pins 34*a* and 34*b* are spaced apart by a distance sufficient to permit a graphite bar heating element to fit therebetween. When a graphite bar heating element is used, the washer 46 abuts the outboard surface of the graphite bar heating element to keep it in place on the support 12 and to prevent abrasive wear of the graphite heating element by pin 34*b*.

A socket 48 is provided for attaching the heater element support 12 to a wall of the electric heat treating furnace. In the embodiment shown in the drawing figures, the socket 48 consists of a cylindrical metallic piece having a central opening 49 for receiving end portion 18 of bar member 14. A pin 50 or other means such as a rib, lip, or key, is disposed transversely in the socket member 48 for engaging with a transverse notch 52 formed in the outboard end portion of bar member 14. The socket 48 is attached to the furnace wall preferably by welding thereto. The heater element support 12 is mounted in the furnace by inserting the outboard end 18 into the central opening 49 of socket 48 and then rotating bar member 14 until the notch 52 engages with pin 50. The heater element support 12 is easily removed by reversing the installation operation. This arrangement is highly resistant to seizing.

In an electric furnace that has heat shielding around the hot zone, the heater element support 12 can be adapted to function as a retainer for the heat shielding. In this regard a second washer (not shown) is disposed around the bar member 14 inboard of the heat shield liner. A hole 54 is formed transversely through the bar member 14 for receiving a retaining clip or wire to hold the retaining washer against the heat shield material.

The metallic components of the heating element support described hereinabove are formed of a metal or alloy that resists distortion when exposed to the elevated temperatures used to heat treat steel alloys and other metals. Preferably, the metal components such as bar member 14, bracket 20, cap 23, and pins 34*a*, 34*b* are formed of molybdenum. The ceramic elements are formed of a strong, heat resisting grade of ceramic material such as high alumina.

In view of the foregoing disclosure, some of the many novel features and advantages of the present invention are now apparent. For example, a novel heating element support has been described which includes a metal bracket that interfaces with the electric heating element so that the heating element does not bear directly on any ceramic components. The bracket 20 and cap 23 are constructed and arranged on the heating element support 12 to minimize contamination or metallization of the surface of the ceramic components that can result in a short circuit between the heating element 10 and the support bar 14. The bracket 20 and cap 23 are also effective to shield the ceramic components from parts, tools, or other objects that can damage the ceramic parts. The disclosed heating element support is easy to replace because only a single clip and pin must be removed to disassemble the support from the heating element and the entire support is removed from or installed in the furnace with a simple ¼-turn motion. Moreover, the heating element support according to the present invention is universal in that it is adaptable for use with metal heating elements as well as graphite bar heating elements.

It will be recognized by those skilled in the art that changes or modifications may be made to the above-described invention without departing from the broad inventive concepts of this invention. It is understood, therefore, that the invention is not limited to the particular embodiments disclosed herein, but is intended to cover all modifications and changes which are within the scope of the invention as defined in the appended claims.

What is claimed is:

1. A support for an electric heating element in an electric heat treating furnace comprising:

a support arm having first and second end portions;

a bracket surrounding the first end portion of said support arm, said bracket having at least three sides;

electrical insulating elements disposed between said support arm and said bracket such that said support arm is electrically isolated from said bracket, said insulating elements including a first ceramic sleeve extending transversely through said support arm, a pair of first ceramic spacers disposed annularly on said first ceramic sleeve and on opposite sides of said support arm so as to prevent contact between said support arm and said bracket, a second ceramic sleeve disposed transversely through said support arm and spaced apart from said first ceramic sleeve, and a pair of second ceramic spacers disposed annularly on said second ceramic sleeve and on opposite sides of said support arm so as to prevent contact between said support arm and said bracket; and means for retaining said bracket on said support arm and for retaining said electrical insulating elements between said support arm and said bracket.

2. A heating element support as set forth in claim 1 comprising a cap disposed over the first end of said support arm and a portion of said bracket that is adjacent thereto, said cap being retained on said support arm and said bracket by said retaining means.

3. A heating element support as set forth in claim 1 wherein said retaining means is disposed through said first ceramic sleeve and extends through two opposing sides of said bracket.

4. A heating element support as set forth in claim 1 wherein said retaining means comprises a pin extending through opposing sides of said bracket, through said insulating elements, and through said support arm.

5. A heating element support as set forth in claim 1 wherein said retaining means comprises a first pin extending through the opposing sides of said bracket and through said first ceramic sleeve and a second pin extending through the opposing sides of said bracket and through said second ceramic sleeve.

6. A heating element support as set forth in claim 1 comprising a socket affixed to a wall of the electric heat treating furnace for receiving and engaging with the second end portion of said support arm, whereby the heating element support is mounted in the electric heat treating furnace.

7. A heating element support as set forth in claim 6 wherein said support arm has a notch formed transversely in the second end portion and said socket includes means for engaging with said notch, whereby the support arm is retained in said socket.

8. A heating element support as set forth in claim 5 comprising a washer slidably disposed around said bracket between said first and second pins.

9. A support for an electric heating element in an electric heat treating furnace comprising:

a support arm having first and second end portions;

first and second ceramic sleeves extending transversely through said support arm, said second ceramic sleeve being spaced apart from said first ceramic sleeve;

a bracket surrounding at least three sides of said support arm and having a transverse interior dimension that is greater than the lengths of said first and second ceramic sleeves;

a pair of first ceramic spacers disposed annularly on said first ceramic sleeve between said support arm and said bracket so as to prevent contact between said support arm and said bracket;

a pair of second ceramic spacers disposed annularly on said second ceramic sleeve between said bracket and said support arm so as to prevent contact between said support arm and said bracket;

a first pin disposed within said first ceramic sleeve and extending through said bracket and a second pin disposed within said second ceramic sleeve and extending through said bracket, whereby said first and second ceramic sleeves and said bracket are supported and retained on said support arm; and means for retaining said first and second pins within said first and second ceramic sleeves and said bracket.

10. A heating element support as set forth in claim 9 comprising a cap disposed over the first end portion of said support arm and a portion of said bracket adjacent thereto; said first pin extending through said cap for supporting and retaining said cap on said bracket and said support arm.

11. A heating element support as set forth in claim 9 comprising a socket affixed to a wall of the electric heat treating furnace for receiving and engaging with the second end portion of said support arm, whereby the heating element support is mounted in the electric heat treating furnace.

12. A heating element support as set forth in claim 11 wherein said support arm has a notch formed transversely in the second end portion and said socket includes means for engaging with said notch, whereby the support arm is retained in said socket.

13. A heating element support as set forth in claim 11 comprising a washer slidably disposed around said bracket between said first and second pins.

14. A support for an electric heating element in an electric heat treating furnace comprising:

a support arm having first and second end portions;

a first ceramic sleeve extending transversely through said support arm;

a second ceramic sleeve extending transversely through said support arm;

said first and second ceramic sleeves being spaced from each other by a distance sufficient to accommodate a graphite bar heating element;

a bracket surrounding at least three sides of said support arm and having a transverse interior dimension that is greater than the lengths of said first and second ceramic sleeves;

a first pair of ceramic spacers disposed annularly on said first ceramic sleeve between said support arm and said bracket and a second pair of ceramic spacers disposed annularly on said second ceramic sleeve between said bracket and said support arm, said first and second pairs of ceramic spacers being dimensioned and positioned to prevent contact between said support arm and said bracket;

a first pin disposed within said first ceramic sleeve and extending through said bracket, whereby said first ceramic sleeve and said bracket are supported and retained on said support arm;

a cap disposed over the first end portion of said support arm and a portion of said bracket adjacent thereto;

a second pin disposed within said second ceramic sleeve, said second pin extending through said bracket and said cap, whereby said second ceramic sleeve, said bracket, and said cap are supported and retained on said support arm; and means for retaining said first and second pins within said first and second ceramic sleeves, said bracket, and said cap.

15. A heating element support as set forth in claim 14 comprising a socket affixed to a wall of the electric heat treating furnace for receiving and engaging with the second end portion of said support arm, whereby the heating element support is mounted in the electric heat treating furnace.

16. A heating element support as set forth in claim 15 wherein said support arm has a notch formed transversely in the second end portion and said socket includes means for engaging with said notch, whereby the support arm is retained in said socket.

17. A heating element support as set forth in claim 14 comprising a washer slidably disposed around said bracket between said first and second pins.

18. A support for an electric heating element in an electric heat treating furnace comprising:

a support arm having first and second end portions, said first end portion being adapted for extending through an opening in the electric heating element;

a bracket surrounding the first end portion of said support arm, said bracket having at least three sides and being disposed over the portion of said support arm so as to extend through the opening in the electric heating element;

electrical insulating elements disposed between said support arm and said bracket such that said support arm is electrically isolated from said bracket; and means for retaining said bracket on said support arm and for retaining said electrical insulating elements between said support arm and said bracket.

19. A heating element support as set forth in claim 18 wherein said insulating elements comprise a first ceramic sleeve extending transversely through said support arm on a first side of the electric heating element; and a pair of first ceramic spacers disposed annularly on said first ceramic sleeve and on opposite sides of said support arm so as to prevent contact between said support arm and said bracket.

20. A heating element support as set forth in claim 18 wherein said retaining means is disposed through said first ceramic sleeve and extends through two opposing sides of said bracket.

21. A heating element support as set forth in claim 19 comprising a second ceramic sleeve disposed transversely through said support arm and spaced apart from said first ceramic sleeve a second side of the electric heating element opposite the first side; and a pair of second ceramic spacers disposed annularly on said second ceramic sleeve and on opposite sides of said support arm so as to prevent contact between said support arm and said bracket.

22. A heating element support as set forth in claim 18 wherein said retaining means comprises a pin extending through opposing sides of said bracket, through said insulating elements, and through said support member.

23. A heating element support as set forth in claim 21 wherein said retaining means comprises a first pin extending through the opposing sides of said bracket and through said first ceramic sleeve and a second pin extending through the opposing sides of said bracket and through said second ceramic sleeve.

24. A heating element support as set forth in claim 18 comprising a socket affixed to a wall of the electric heat treating furnace for receiving and engaging with the second end portion of said support arm, whereby the heater element support is mounted in the electric heat treating furnace.

25. A heating element support as set forth in claim 24 wherein said support arm has a notch formed transversely in the second end portion and said socket includes means for engaging with said notch, whereby the support arm is retained in said socket.

26. A heating element support as set forth in claim 13 comprising a washer slidably disposed around said bracket on the first side of the electric heating element.

27. A heating element support as set forth in claim 18 comprising a cap disposed over the first end of said support arm and a portion of said bracket that is adjacent thereto, said cap being retained on said support arm and said bracket by said retaining means.

* * * * *